US006151860A

United States Patent [19]

Reisdorff

[11] Patent Number: 6,151,860

[45] Date of Patent: Nov. 28, 2000

[54] METHODS OF RAISING UTILITY POLE TRANSMISSION CABLES

[75] Inventor: Robert A. Reisdorff, Seward, Nebr.

[73] Assignee: Laminated Wood Systems, Seward, Nebr.

[21] Appl. No.: 09/324,561

[22] Filed: Jun. 3, 1999

Related U.S. Application Data

[63] Continuation-in-part of application No. 08/968,279, Nov. 12, 1997.

[51] Int. Cl.[7] ..... E04H 12/00

[52] U.S. Cl. ..... 52/651.02; 52/170

[58] Field of Search ..... 52/651.02, 632, 52/170, 122.1, 165, 514, 726.4, 741.14, 745.17; 405/230, 231, 232

[56] References Cited

U.S. PATENT DOCUMENTS

| | | |
|---|---|---|
| 253,743 | 2/1882 | Mensing . |
| 877,268 | 1/1908 | Van Buren . |
| 1,679,297 | 7/1928 | Ehrler . |
| 2,040,010 | 5/1936 | McMahon . |
| 2,530,807 | 11/1950 | Campbell . |
| 3,317,185 | 5/1967 | Burk et al. . |
| 3,350,822 | 11/1967 | Nachazel . |
| 3,464,169 | 9/1969 | Potain . |
| 4,044,513 | 8/1977 | Deike . |
| 4,048,779 | 9/1977 | Valenziano et al. . |
| 4,096,673 | 6/1978 | DeMuth . |
| 4,097,165 | 6/1978 | Quayle . |
| 4,197,689 | 4/1980 | Mastalski et al. . |
| 4,678,372 | 7/1987 | Cousty . |
| 4,697,396 | 10/1987 | Knight . |
| 4,756,130 | 7/1988 | Burtelson . |
| 4,802,317 | 2/1989 | Chandler . |
| 4,991,367 | 2/1991 | McGinnis . |
| 5,031,370 | 7/1991 | Jewett . |
| 5,337,469 | 8/1994 | Richey . |
| 5,383,749 | 1/1995 | Reisdorff et al. . |
| 5,661,946 | 9/1997 | Davis . |
| 5,794,387 | 8/1998 | Crookham . |

*Primary Examiner*—David M. Purol

*Attorney, Agent, or Firm*—Reising, Ethington, Barnes, Kisselle, Learman & McCulloch, P.C.

[57] ABSTRACT

A method of raising the transmission hardware carried by a utility pole having a base end with a ground foundation supporting the pole in upright position, without disturbing the pole foundation or disconnecting the cables, includes the steps of securing opposed, circumferentially spaced elongate pole support members to extend upwardly along the pole and severing the pole to define a first pole supported by the pole foundation and a second pole supported by the first pole; fixing the support members to the first pole and slidably banding them to the second pole; raising the second pole above the first pole to a level remaining below the upper ends of the support members; and fixing the lower end of the second pole within and to the upper ends of the support members at a spaced distance above the first pole. The method further contemplates the releasable securement of ladder steps to at least one of the support members to provide ready access for carrying out some of the method steps.

20 Claims, 10 Drawing Sheets

10
SL
12
G
10
10
13a
13
13a
12
13b
10
13a
13
12
14
10
13a
13
15
13a
12
SL
14
G
13
15
10

FIG-11
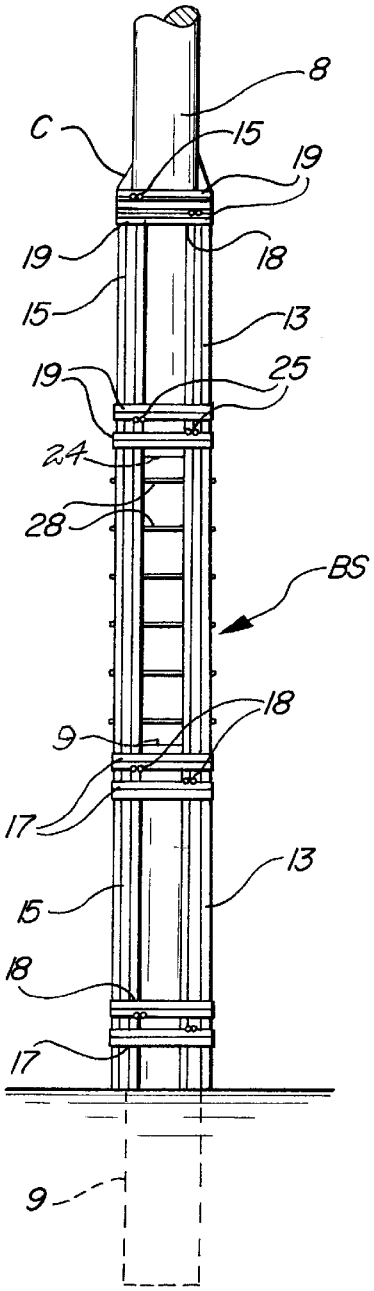
FIG-13
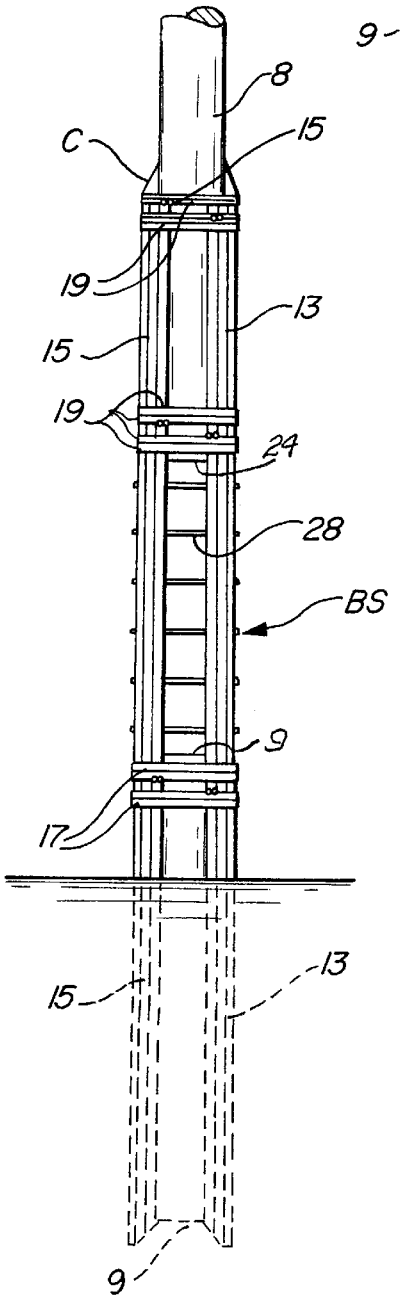
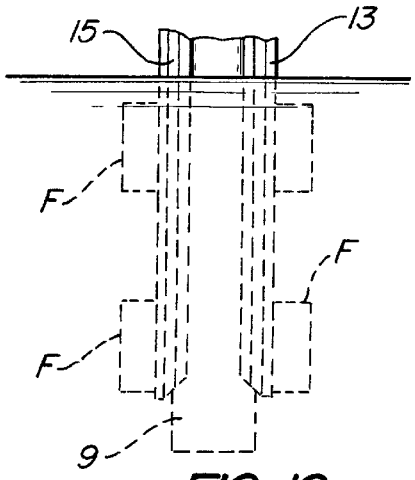
FIG-12
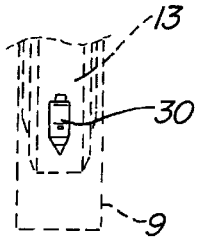
FIG-14

METHODS OF RAISING UTILITY POLE TRANSMISSION CABLES

The present invention is a continuation in part of application Ser. No. 968,279, filed Nov. 12, 1997, which relates to methods of raising the transmission and/or communication cables and other hardware carried by a utility pole without disturbing the pole foundation or necessitating disconnecting and reconnecting the cables and other framing and hardware.

The electric utility industry is seeking to correct existing ground clearance problems or increase the capacity of existing electric power transmission lines while maintaining the ground clearance which must be observed below the height of the power transmission cables or lines. Utilities have increased the ampacity carried by power lines to meet ever-increasing peak loading conditions, such as, for example, occur with seasonal air-conditioning loads. This increased ampacity heats up the lines, which then begin to sag further.

Typically, the industry has added a pole top extension to the top end of a utility pole to eliminate the need to replace or change out the existing utility pole. When pole top extensions are utilized, the power lines, communication lines, and other equipment carried must be disconnected and reconnected to the top of the pole extension which, of course, results in considerable downtime for the entire power transmission or communication system. Moreover, such pole top extensions are not rated for heavy equipment such as transformer support, and in many instances, the only acceptable approach has been to remove the pole and replace it with a longer pole.

For a discussion of conventional, commercial extensions which have been used in very recent years, attention is invited to U.S. Pat. No. 5,661,946, which I incorporate herein by reference.

The present method is concerned with increasing the height of a utility pole without the need of shutting down the operation of the poles or pole clusters which typically may be located 1000 feet apart, without removing and replacing the base of each pole from the earth, or disturbing its position in the earth by raising it. The pole is braced while severing it to define a first pole or pole portion supported by the pole foundation, and a second pole or pole portion caged by elongate support members. During severing of the pole, the pole is supported by generally opposed, circumferentially spaced elongate support members which extend upwardly along the pole to brace both the first pole and the second pole. The support members are secured to the first pole and initially slidably banded around the second pole. Hydraulic jacks connected between the first and second poles may then be provided to raise the second pole to a predetermined level above the first pole. Thereafter, the hydraulic jacks are removed and the lower end of the raised second pole is fixed within and to the upper ends of the support members in a cable raising position. Typically, the second pole may be raised five feet or more above the first pole.

A prime object of the invention is to provide a method of increasing the height of the existing electric utility and/or telecommunication cables and hardware which are supported by a utility pole, without the need for removing the cables and hardware and shutting down the system.

Another object of the invention is to provide a method of raising the cables and other equipment without removing and replacing the poles.

Still another object of the invention is to provide a method which is readily practiced, and permits accomplishment of its function in a reliable and economical manner.

Still a further object of the invention is to provide a method of raising the power transmission lines and other equipment carried by utility poles in a manner to maintain the foundation strength of the poles, and provide a structure which is extremely durable and will withstand severe wind storms and other structure-stressing climactic conditions.

Another object of the invention is to provide a method of the character described wherein ladder brackets are removably fixed to the pole support channel members to facilitate completion of the overall pole assembly and for any potential future climbing which may be necessary.

Still a further object of the invention is to provide a method of the type described which is sufficiently versatile and cost effective to raise transmission hardware on pole which have had pole reinforcing channels affixed to them.

Other objects and advantages of the invention will become apparent with reference to the accompanying drawings and the accompanying descriptive matter.

The presently preferred embodiments of the invention are disclosed in the following description, and in the accompanying drawings, wherein:

FIG. 11 is side elevational view, similar to FIG. 8, but illustrating an alternative method in which the sole support members do not extend into the ground;

FIG. 12 is a similar fragmentary view of another embodiment in which flanges are fixed on the lower ends of the pole support members;

FIG. 13 is a similar fragmentary view of still another embodiment; and

FIG. 14 is a similar fragmentary view of still a further embodiment.

Figure 1:
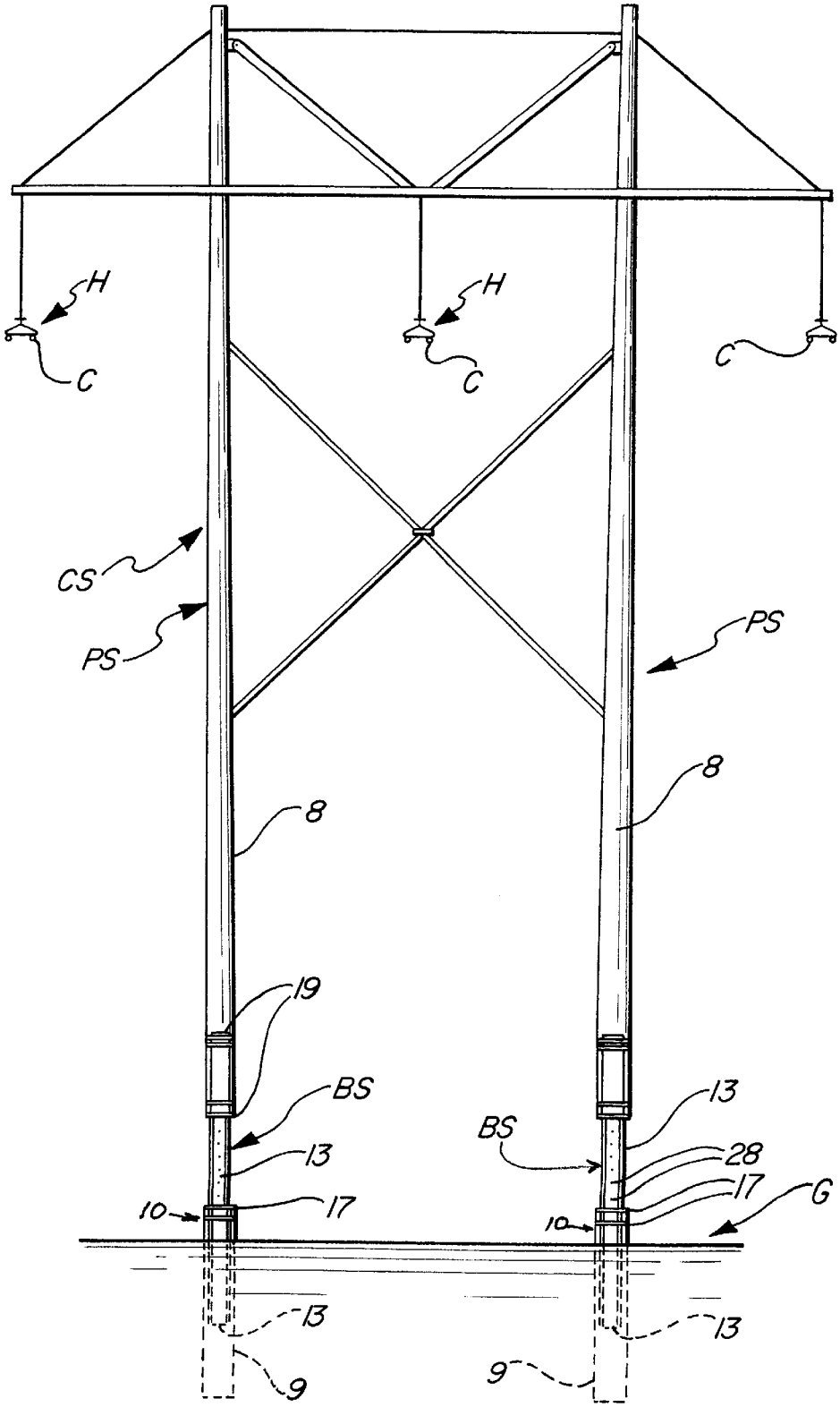
FIG. 1 is a side elevational view illustrating a retrofitted pole cluster wherein the power transmission elements have been raised practicing the method of the present invention.

In FIG. 1, the overall cluster structure, generally designated CS and commonly referred to as an H-Frame tangent structure, is shown as comprising spaced apart, retrofitted pole structures, generally designated PS for supporting power transmission hardware, generally designated H, including power transmission conductors or cables such as shown at 7, telecommunications cables, transformers, guying, and other electrical hardware and equipment. While two pole structures PS are shown for convenience sake, it is to be understood that the cluster could be a three pole structure or four pole cluster structure, or even a single pole structure could have been illustrated. As FIG. 1 indicates, the pole structures PS are embedded a pre-designated distance in the ground, and typically they extend into the ground a distance of 10% of the initially embedded pole length plus 2 feet. Each retrofitted pole structure PS, in FIG. 1, includes an upper pole section or pole 8 and a lower pole or pole section 9, separated by bridging and support structure generally designated BS.

Figures 2, 3, 4, 5:
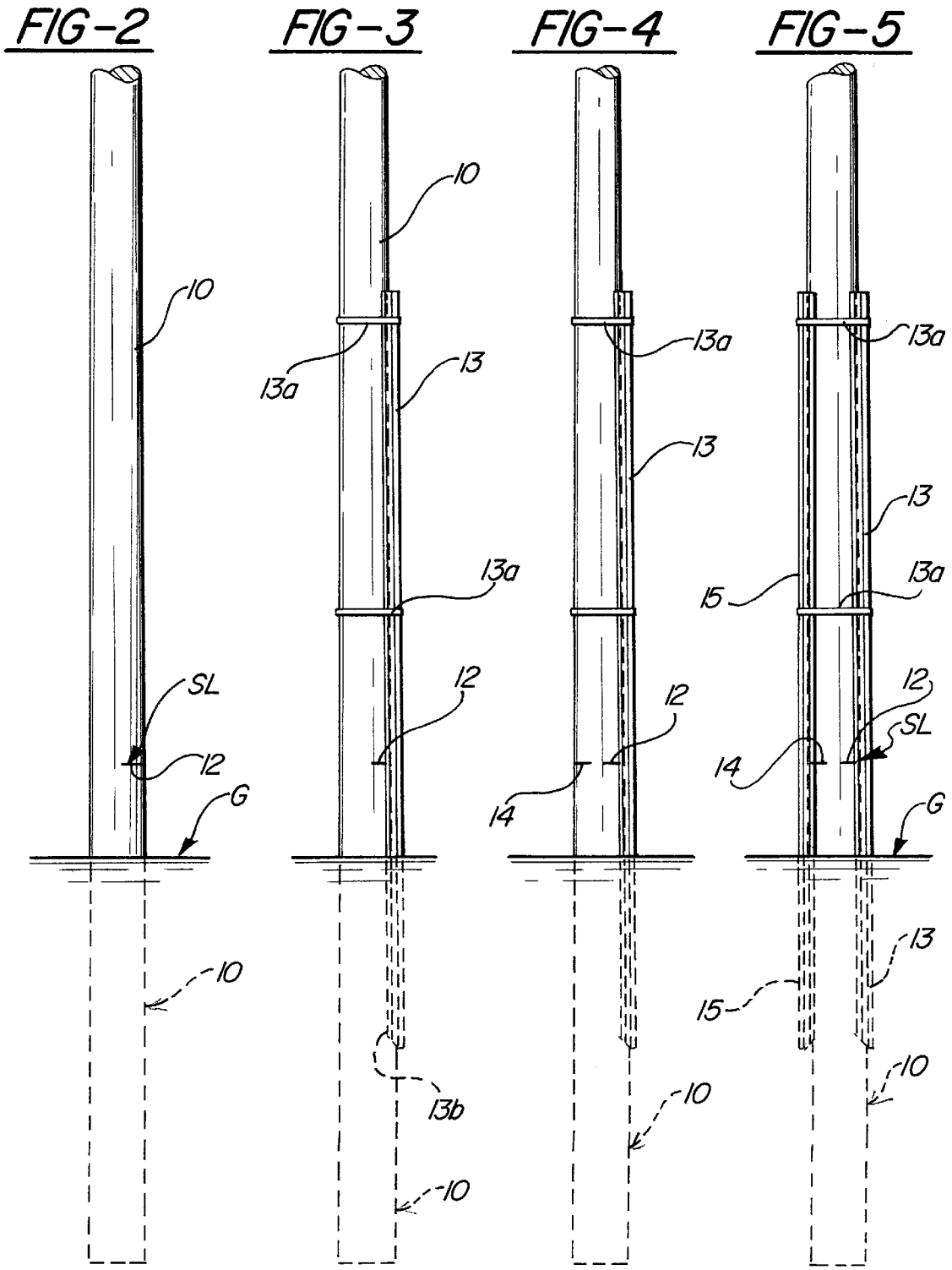
FIGS. 2–7 are side elevational views sequentially illustrating the various method steps which are followed in retrofitting the structure.
Figure 10:
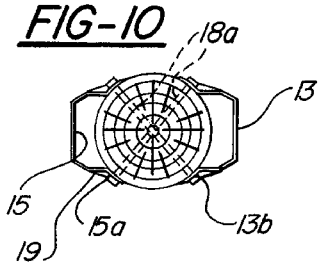
FIG. 10 is a sectional, elevational view taken on the line 10—10 of FIG. 8.

In FIG. 2, a typical originally installed pole 10, which is embedded in the ground G a pre-designated depth to provide a solid foundation for the pole 10, is shown as having been partially cut, notched, or slit, as at 12, at what may be termed a "severing level" generally designated SL. In the next step in the process, a preferably steel channel or pole support, generally designated 13, is temporarily banded to the pole 10 as at 13*a* above the level SL and driven into the ground alongside the pole 10. It will be noted that in final position the channel 13 extends upwardly a considerable distance along the pole beyond the slit 12. Typically, the member 13 may be 20 feet in length and driven a distance of 5–6 feet into the ground alongside the pole. As FIG. 10 shows, the channel or support member 13 is configured at its ends 13*b* (see FIG. 10) to the shape of the pole to guide on the pole, and may be said to embrace it. The banding 13*a* may be conventional, girth adjustable, removable nylon banding which circumferentially holds the channel to the pole 10 without binding it to the point it interferes with downward movement of the channel 13. Alternatively, a conventional tightenable chain of the type shown in the present assignee's U.S. Pat. No. 5,383,749, which is incorporated herein by reference, may be used. This adjustable chain is shown at 37 in the patent and the same driving rig disclosed in U.S. Pat. No. 5,383,749, or other suitable equipment, may be used to drive the channel 13 down into position.

The next step in the method is to cut a second slit or notch 14 on the same level SL on the opposite side of the pole, which again does not extend all of the way through the pole to the slit 12. Then, after removing banding 13*a* and resecuring it to also embrace a second opposed pole support or channel 15 in the same manner, the second extension or channel member 15, which is identical to member 13, is driven into the ground on the opposite side of the pole, as shown in FIG. 5. Both slits 12 and 14 are cut deeply enough to extend circumferentially beyond the members 13 and 15 and the channel 15 is formed with similar pole engaging edges 15*a* as shown in FIG. 10. The channel 13 and 15 are also configured with facial portions 13*c* and 15*c*, respectively, and corner portions 13*d* and 15*d*, respectively.

Figure 6:
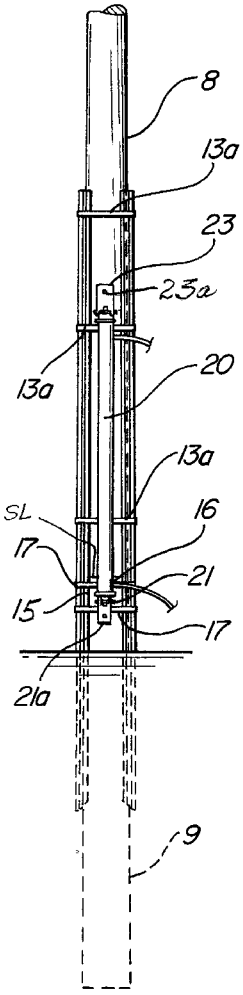
Figure 7:
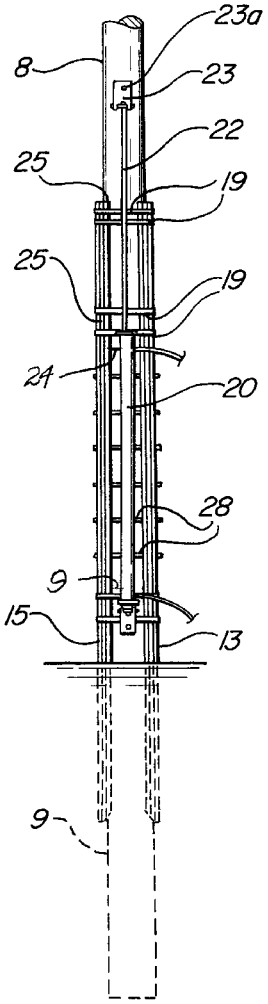

In FIG. 6, it will be noted that the banding 13*a* has been rearranged to encompass both members 13 and 15, and a new lower band 13*a* added, and the original pole 10 is then cut through completely between the members 13 and 15, as at 16, at the same level SL. A complete severance of the original pole 10 at 16 between slits 12 and 14, as shown in FIG. 6 and 7, forms the base pole 9 and the second separate pole or pole portion designated 8. The extension members or channels 13 and 15 are then, or previously, permanently affixed to the lower pole or pole portion 9 by through bolts 18, and by steel bands 17 which embrace the members 13 and 15, and the pole 9, and bolt to it. The temporary bands 13*a* are removed from the lower portion of the pole in the process. The steel bands 17 may be of the type described in the aforementioned patent which have their overlapping portions secured by a crimping tool.

Then, at opposite sides of the base pole 9, a pair of hydraulic cylinders or jacks 20 are provided externally circumferentially between the members 13 and 15 to attach to the base pole 9, as at tees 21 which have fasteners 21*a* reliably, releasably securing them in position. The cylinder rods 22 of jacks 20 are secured to the upper poles or pole portions 8 at the tees 23 by similar fasteners 23*a*. The members 13 and 15 remain temporarily banded to the pole portion 8 as at 13*a* in a manner to accommodate upward sliding movement of the pole portion 8.

As FIG. 7 demonstrates, the next step is to utilize the hydraulic jacks 20 to raise the pole 8 upwardly a distance of typically 5–7 feet to the level 24. Alternatively, where the terrain permits, a crane could be utilized. Once this has been accomplished, the bands 13*a*, which previously permitted the upper pole section 8 to slide upwardly, may be removed and permanent steel bands 19, similar to bands 17, may be bolted in position. Bolts 25 of the same character as bolts 18, which extend all the way through the pole, additionally are installed. The bolt members 18, as FIG. 10 indicates, which secure the edges 13*b* of the members 13, and the edges 15*a* of the members 15 to the poles 8 and 9 extend all the way through the poles, as shown in FIG. 10.

Figure 8:
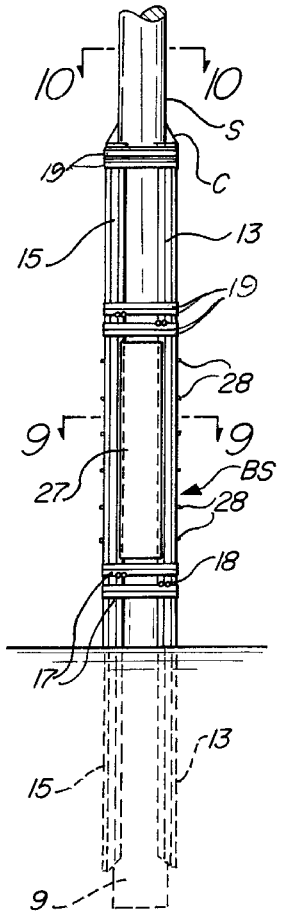
FIG. 8 is a side elevational view on a slightly different scale.

Threaded rods 28, provided with nuts and lock-nuts, or elongate bolts, can be secured at vertical intervals, i.e., 18 inches, between poles 8 and 9, as shown in FIG. 7 to further unite the members 13 and 15. The rods 28 are inserted progressively as the pole 8 is moved upwardly beginning with the two lower rods 28. One rod 28 is always kept in place above a rod which is being tightened down. Thereafter, the releasably installed, hydraulic jacks 20 may be removed by simply backing off the bolts or fasteners 21*a* and 23*a* which secure to the wood pole portions 9 and 8 respectively. The space embraced by the bridging structure BS between the poles 8 and 9 is then covered by elongate curvilinear steel plates 27 which fasten or nail as at 27*a* to the poles 8 and 9 and overlie the channel edges 13*b* and 15*a*. Surrounding caps C (shown only diagrammatically) which nail to the pole and overlap the upper ends of the channels 13 and 15 are also provided. In FIG. 8, a distance of 5 feet is provided between the upper end of the lower pole portion 9 and the lower end of the upper pole portion 8, and the structural rise is, of course, 5 feet. The bolts 17, 18, 18*a*, 19, and 25, bands 17 and 19, and rods 28 may be generically referred to as fastener elements.

In FIG. 11, an alternative method is illustrated in which the principal difference between FIGS. 8 and 11 is that the channels 13 and 15 are not driven into the ground. In this case, the severing level SL is raised and the channels 13 and 15 are secured to the pole section 9 by two pairs of steel bands 17 and additional bolts 18. In this installation, there is adequate ground line capacity to support the increased structural height.

In FIG. 12, an embodiment of the invention is illustrated in which pairs of linear flanges F are welded or bolted to the lower ends of the members 13 and 15, as shown, to provide additional foundation stabilization in some types of earth.

In FIG. 13, an alternative method is indicated in which the channels 13 and 15 are driven down below the lower end of the pole portion 9 when it is suspected that the lower end of the pole may be decayed to some extent at its lower end. In this case, the severing level SL is lowered, as will be seen.

Finally, in FIG. 14, still another embodiment is illustrated in which flip feet 30 of the character disclosed in the aforementioned U.S. Pat. No. 5,383,749 are utilized for increased uplift and thrust capacity.

Typically, the utility poles in use today are wood poles, or laminated wood poles, but may be metallic or plastic, or otherwise constituted in nature. Typically, the channels 13 and 15 are installed by driving them into place, or digging them into place, depending upon the nature of the terrain.

Figure 15:
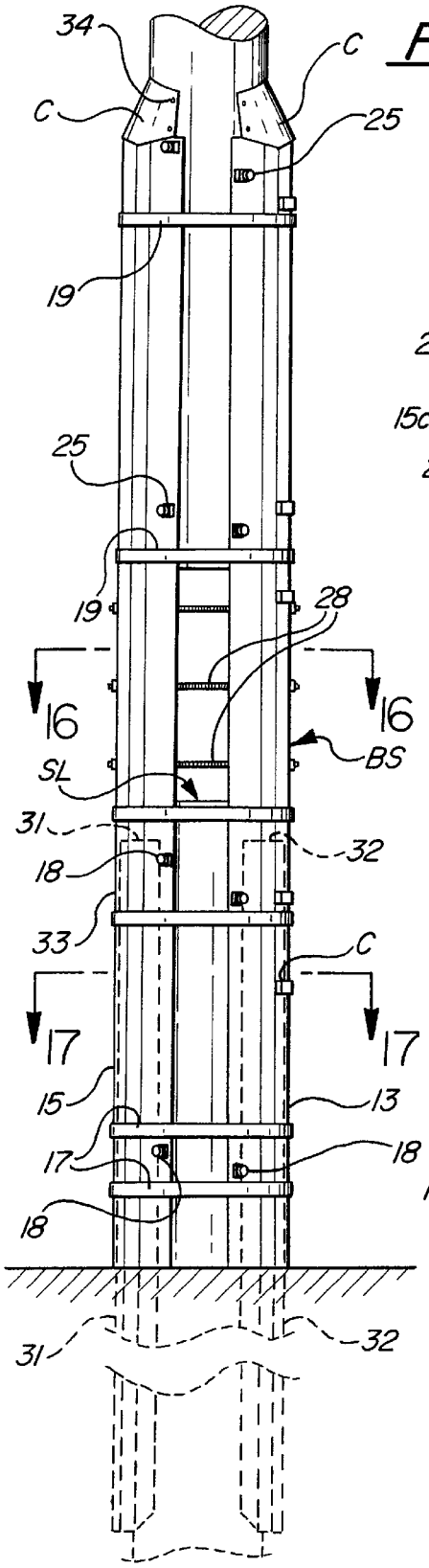
FIG. 15 is a schematic side elevational view illustrating an embodiment of the invention in which a previously pole channel reinforced pole can have its transmission hardware raised.
Figure 16:
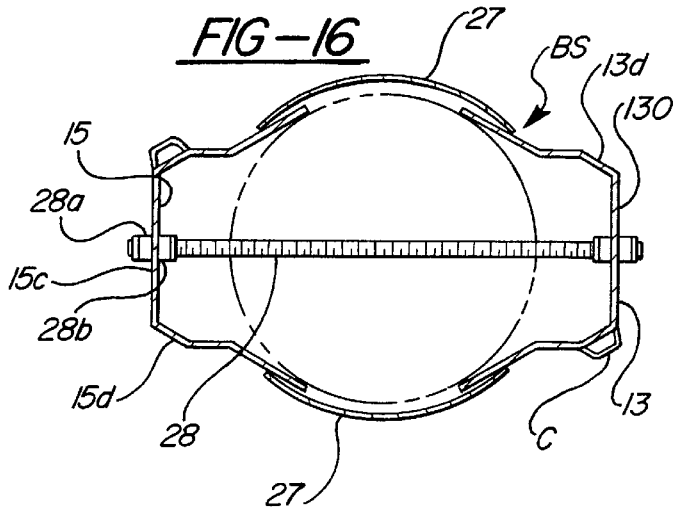
FIG. 16 is an enlarged transverse sectional view taken on the line 16—16 of FIG. 15.
Figure 17:
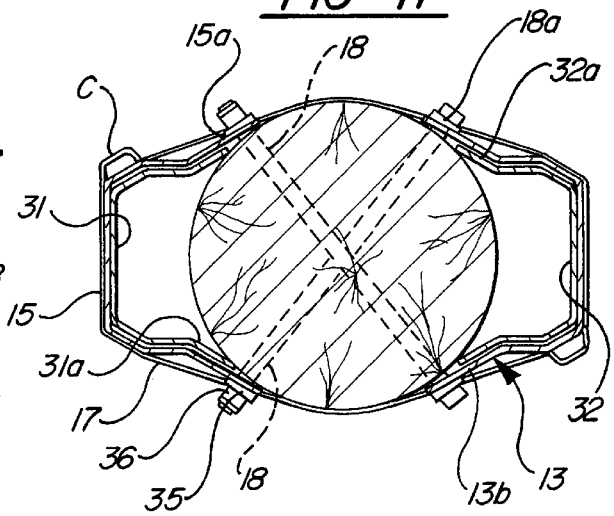
FIG. 17 is an enlarged transverse sectional view taken on the line 17—17 of FIG. 15.

In FIGS. 15–17, the method of effectively raising a pole, when existing pole support members 31 and 32, of the character described in U.S. Pat. No. 5,383,749 have been driven into place to support a pole lower section which has had some deterioration, is disclosed. The configuration of the channel members 31 and 32 is particularly shown in FIG. 17, following removal of any protruding bolts or nuts, such as shown at 33, which formerly helped fasten the upper ends of reinforcing members 31 and 32 to the pole. The members 31 and 32 have vertical edges 31*a* and 32*a*. The method disclosed in FIGS. 2–10 is followed in the construction of the raised pole structure, except that the members 31 and 32 rest on the ground in the manner of FIG. 11, and the members 13 and 15 are configured, as shown in FIG. 17, in a manner to conform to the members 31 and 32, and nest over or overlie them. As FIG. 17 discloses, the side edges 13*b* and 15*a* of the members 13 and 15 extend beyond the side edges 31*a* and 32*a* of the members 31 and 32 so that the members 13 and 15 can be directly bolted to the severed pole portions and, in so doing also secure the members 31 and 32 which have had protruding nuts removed. It will be noted that the edges 31*a*–15*a* and 32*a*–13*b* are parallel and abutting, and the edges 31*a*, 32*a* are clamped to the pole by the fasteners 18. The severing level SL is above the upper ends of the members 31 and 32.

The threaded rods 28, as shown in FIG. 16, may have nuts 28*a* and lock nuts 28*b* at both their respective ends. Clips C may be used for the attachment of rungs. The caps C are shown in FIG. 15 as nailed into position by nails 34. The steel banding 17 embraces both the members 15–31 and 13–32 and may be of the common two inch width variety. As FIG. 17 indicates, the bolts 18 and 25 are provided with beveled or curved washers 35 and beveled or curved washers 35 are also used with the lock nuts 36.

Figure 18:
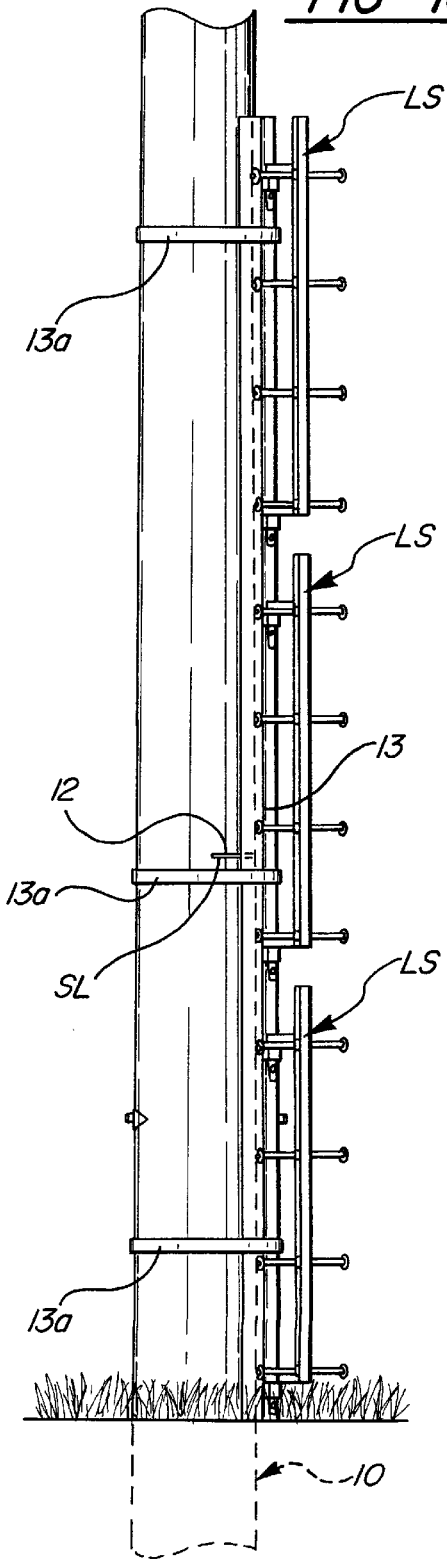
FIGS. 18–24 are side elevational views sequentially illustrating the method steps followed in a still further embodiment.
Figure 22:
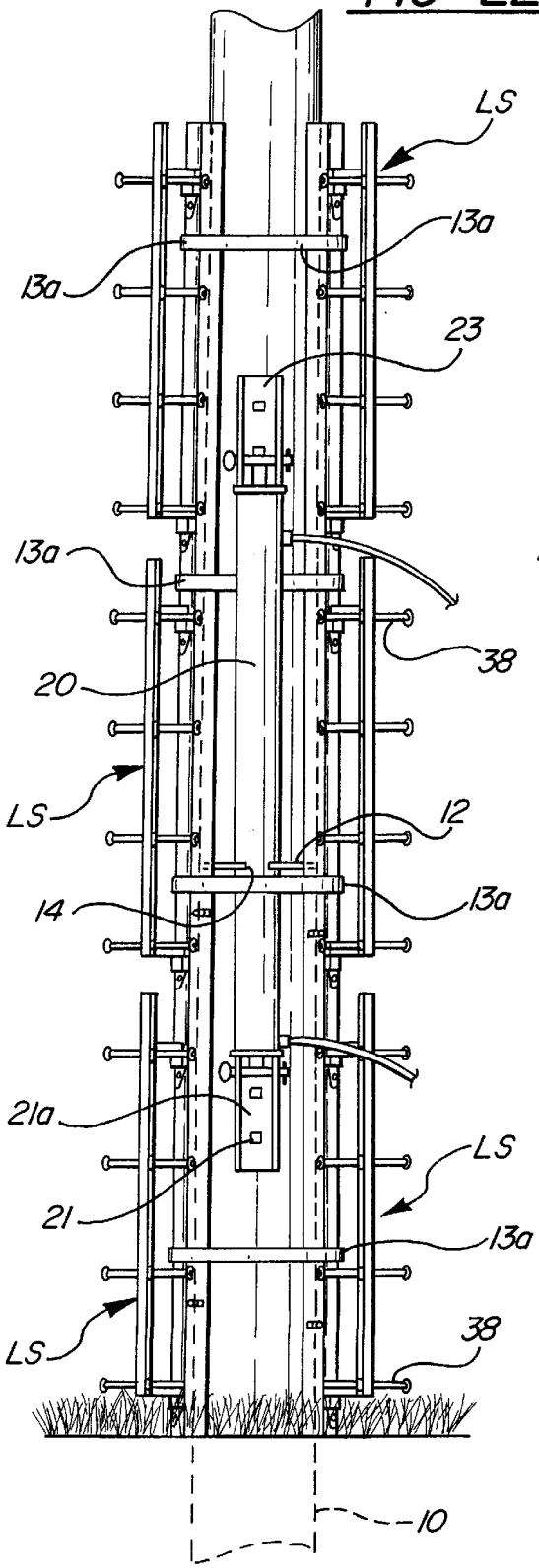
Figure 23:
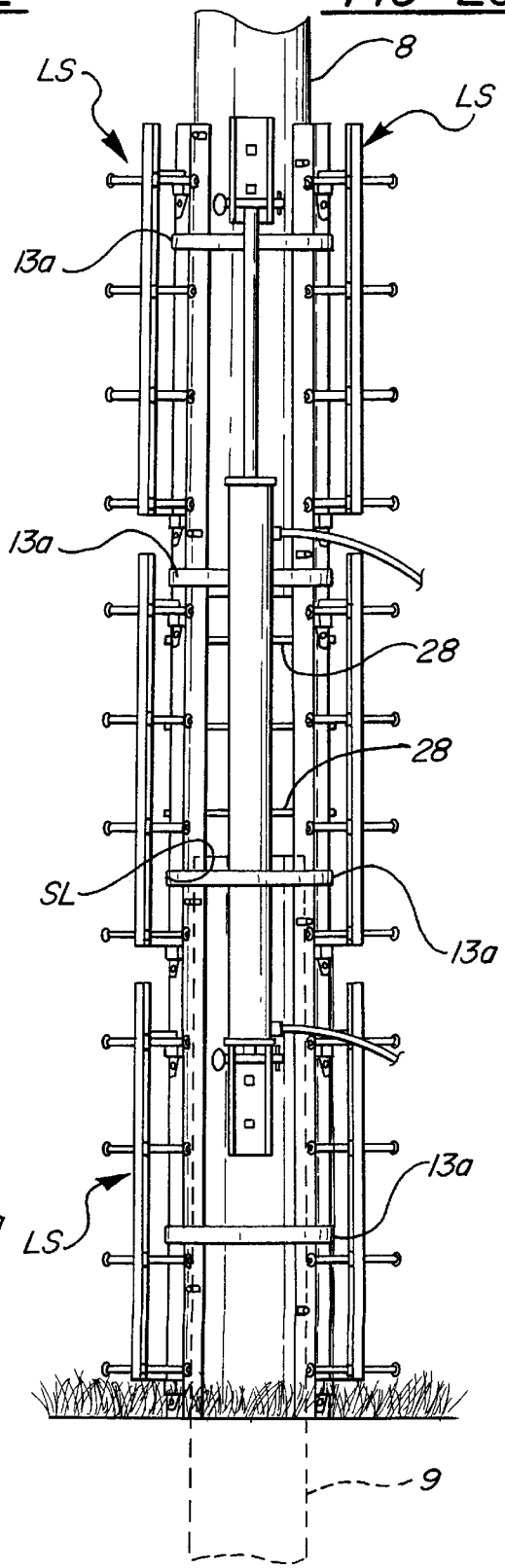
Figure 24:
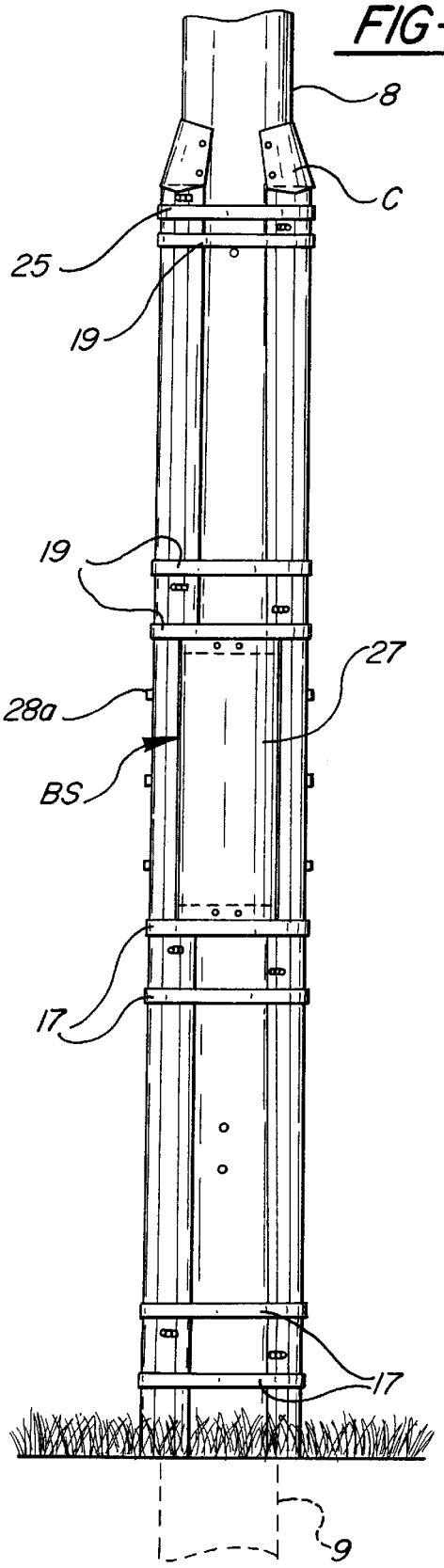
Figure 25:
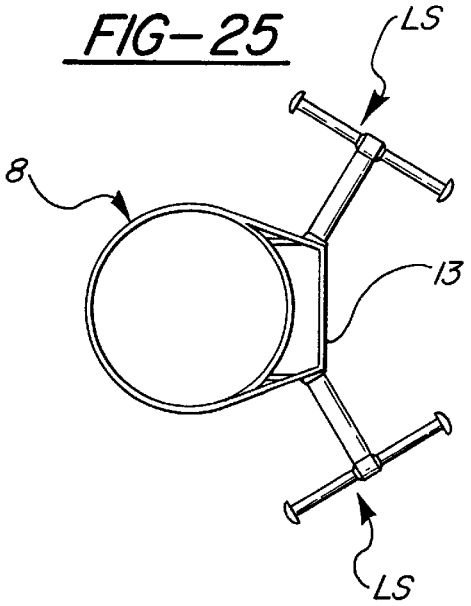
FIG. 25 is a schematic top plan view illustrating the releasable securement of ladder sections to the pole support members.

FIGS. 18–27 describe a further inventive method, which is similar to the method described in FIGS. 2–10, with respect to erecting a structure similar to that disclosed in FIG. 11, wherein the members 13 and 15 rest on the ground instead of being driven through into the ground. In these figures also, like numerals identify components or portions of components which are common to these previously disclosed for the sake of convenience. Referring particularly to FIG. 18, in the first instance, it will be noted that the view is similar to FIG. 3, wherein the pole has been provided with the partial cut 12 at severing level SL, and the pole member 13 has been secured in position by a pair of temporary bands 13*a* below the level SL and a temporary band 13*a* near the upper ends of channel 13. Prior to providing the cut 12, holes for the later reception of bolts are drilled. In FIGS. 18–23, ladder sections or devices, generally designated LS, have been fixed to the rigid channel member 13 and 15 at each corner, in the manner illustrated in FIG. 25, to provide overall ladders or ladder devices, generally designated L. In FIG. 24, the ladder strips LS have been removed and permanent banding 17, 19, and 25 has been installed, following removal.

Figure 26:
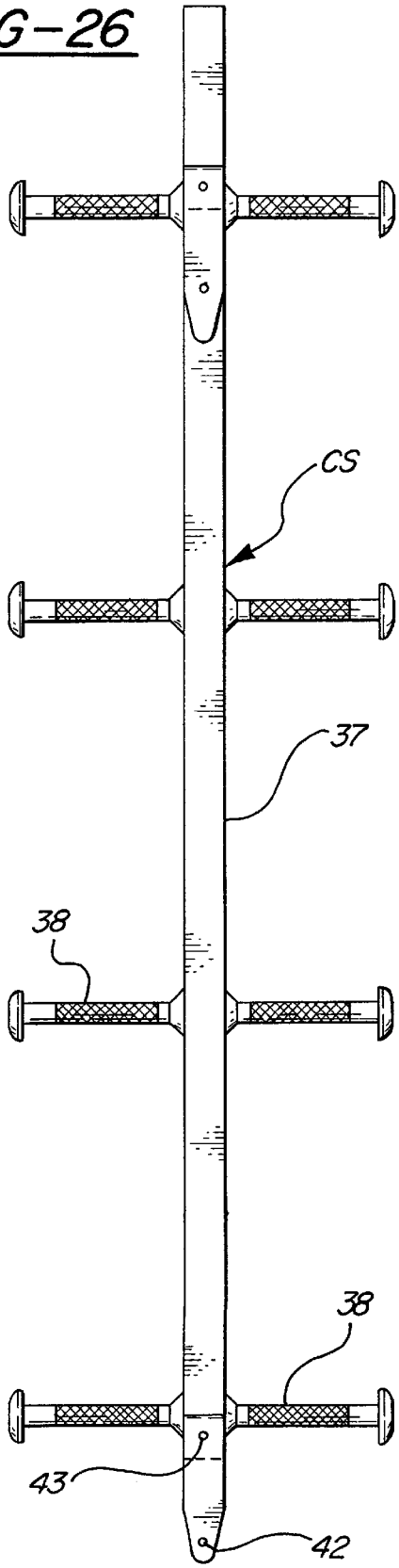
FIG. 26 is an enlarged rear elevational view of one of the ladder strips employed.
Figure 27:
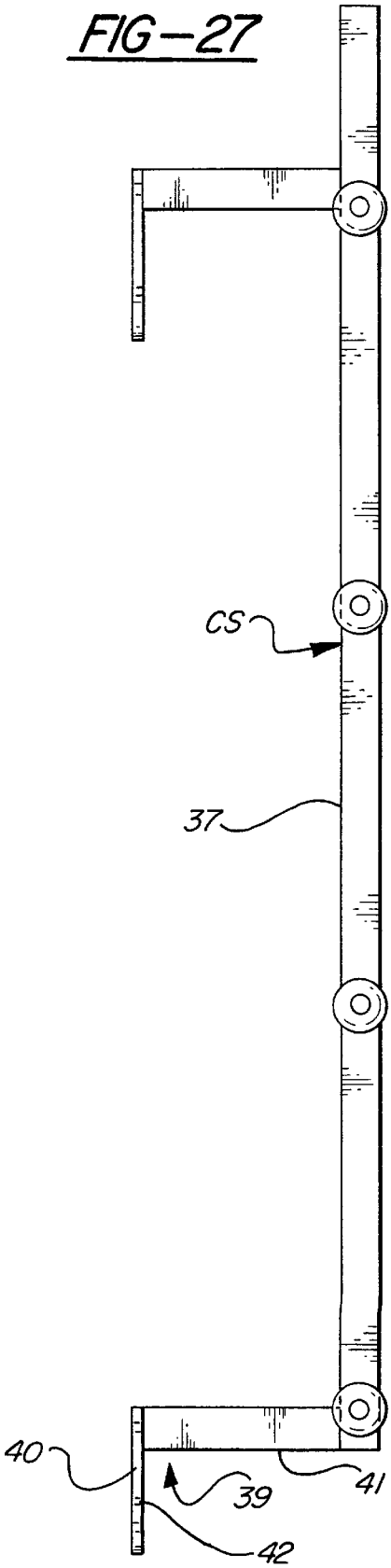
FIG. 27 is a side elevational view thereof.

FIGS. 26–28 particularly disclose one of the ladder sections LS, which each comprise a vertical tubing member 37 on which step members or rungs 38 are fixed at predetermined convenient vertical intervals for climbing, i.e., fifteen inch intervals. A typical overall length of a ladder section LS, as shown in FIG. 27, would be four feet six and ⅜ inches. Provided to position the step members 38 out away from the pole, are mounting brackets, generally designated 39, which include securing plates 40 and spacers 41. These tubular spacers of square cross section 41 may be welded to the vertical members 37 which are also of square cross section, and to the mounting plates 40, which have bolt holes 42 and drain holes 43. In assembled position, the ladder members LS are shown fixed to both corners of the members 13 and 15 in the manner indicated in FIG. 25, but fewer working ladder members LS than shown may be utilized in some working conditions or locations.

Returning now to FIG. 18, and after the partial cut 12 is accomplished at a severing level SL, a channel member 13 is first installed as previously, utilizing temporary bands 13*a*. The channel members 13, as previously illustrated in FIGS. 9 and 10 include edge portions 13*b*, an outer face portion 13*c*, and corner portions 13*d*. Typically, the pole support member or channel 13 which, it will be noted, rests on the ground in FIG. 18, may be 8 feet in length, plus the height the upper section of the pole will be raised (i.e. seven feet) when that step is eventually completed. With the channel 13 in place, ladder sections LS may then be mounted on it on the corners 13*d*. In FIG. 18, three vertically spaced ladder sections LS are mounted, beginning with the lower one first of all, and then moving upwardly. Bolt and nut assemblies extending through the openings 42 in each ladder section plate 40 releasably fix the ladder sections LS to the channel 13.

Figure 19:
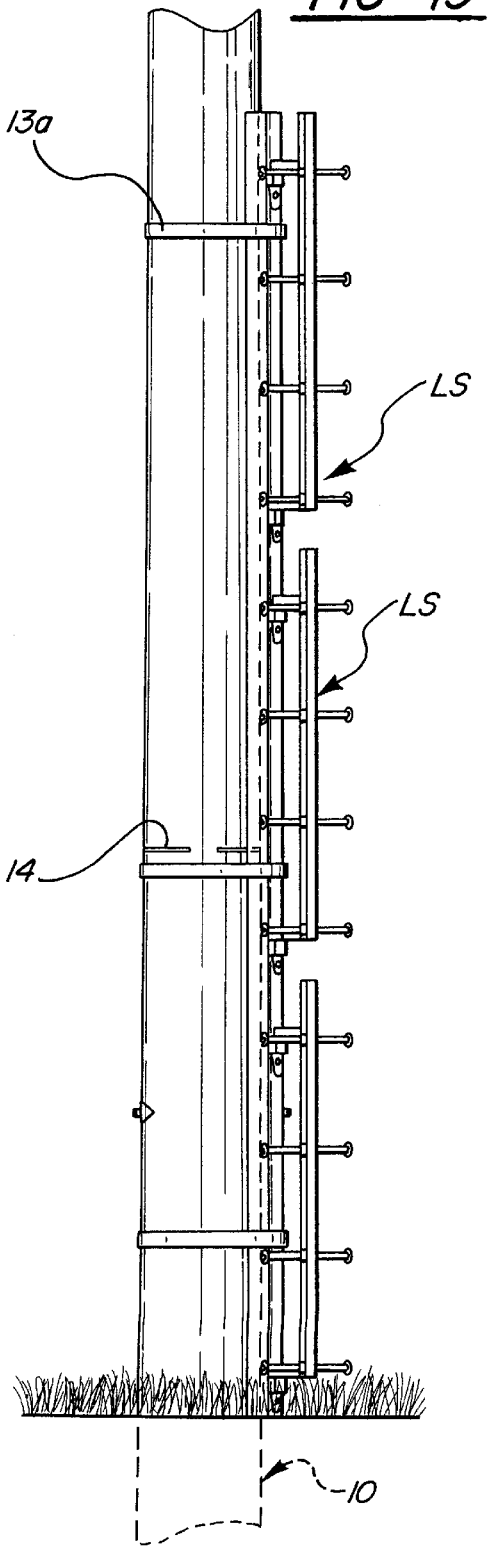

As FIG. 19 indicates, a second notch 14 is then cut in the pole (see FIG. 14), and the second pole support member or channel 15 is then disposed adjacent the pole (see FIG. 20) and secured with replaced bands 13*a*, which replace the bands previously used in the sense that they extend around and temporarily band each of the members 13 and 15 to the pole. At this time, the members 13 and 15, below the notches 12 and 14, are bolted to the lower end of the pole by affixing bolts 18 which extend in the manner indicated in FIG. 10 from the edges 15*a* of channel 15 through to the edges 13*b* of channel 13 diagonally. The bands 13*a* used as temporary banding may, of course, be the nylon bands referred to previously, and the permanent banding 17 and 19 may comprise steel strips having overlapping portions secured by a crimping tool. Once the bolts 18 are in place in the predrilled openings, the bands 13*a* can be removed, and replaced with new temporary banding 13*a* which envelope the channel 15 as well as the channel 13.

Figure 21:
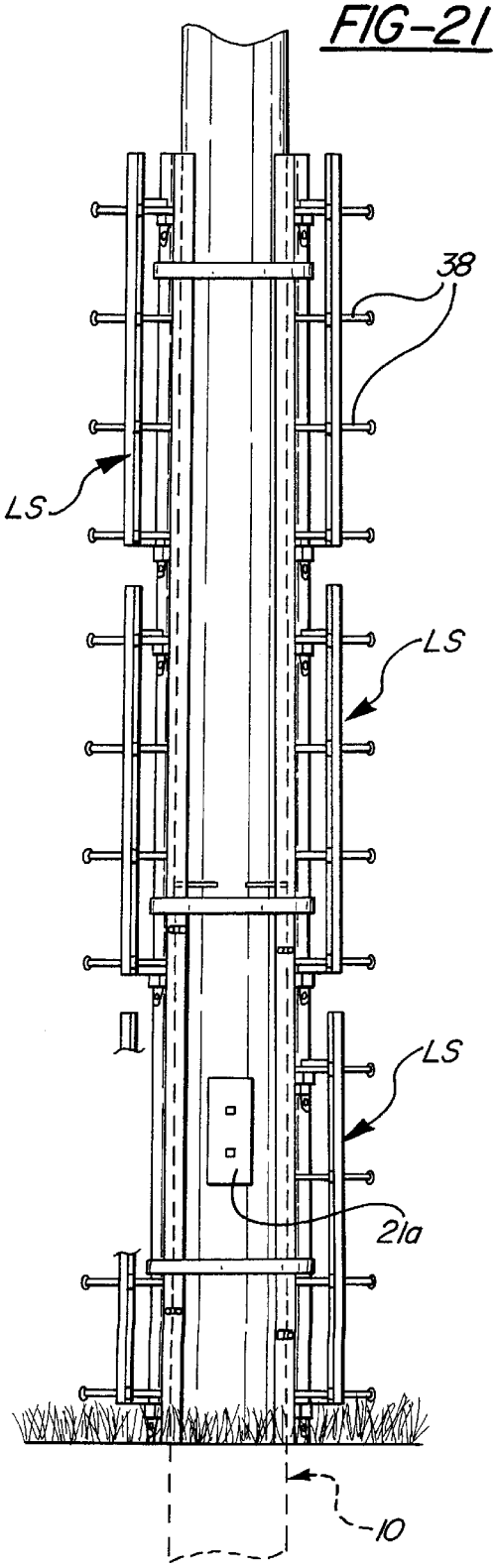

In FIG. 21, it will be noted that the ladder strips LS have been secured to both corners of the upstanding channel member 15 which rests on the ground in the same manner as channel strip 13. The ladder strips LS are secured to channel 15 in the same manner by bolts extending through the openings 42 in the plates 40 which are secured by nuts in the usual manner.

As FIGS. 21 and 22 indicate, at opposite sides of the lower end of the pole, a pair of hydraulic cylinders or jacks 20 are provided circumferentially between the members 13 and 15, using tees 21 secured by releasable fasteners 21*a*. The cylinder rods 22 of the jacks 20 are then secured to the portion of the pole above the severing level LS by tees 23 secured by similar releasable fasteners 23*a*. With the tees 21 and 22 secured in position as shown in FIG. 22, the pole is completely cut through at the severing level SL as at 16 before the hydraulic cylinders are secured in position, using shallow wedges driven into the cuts 12 and 14 to support the structure so that it does not bind the saw and to prevent its falling the distance of the saw kerf. This is easily accomplished using a chainsaw or the like to cut each unsevered side of the pole and connect the slits 12 and 14.

Figure 9:
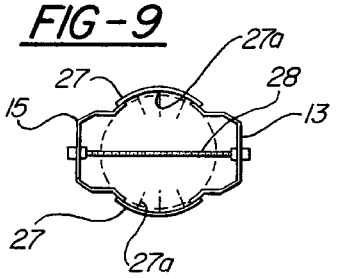
FIG. 9 is a sectional elevational view taken on the line 9—9 of FIG. 8.

In FIG. 23, the cylinder rods 22 have been extended to raise the upper pole or pole portion 8, and bolts 25 have thereafter been installed in the crisscross manner utilized with bolts 18, as indicated in FIG. 10. In addition in FIG. 23, the threaded rods 28 as shown in FIG. 9 have been consecutively installed in the manner previously described.

In FIG. 24, the temporary plastic banding 13*a* has been replaced by permanent steel banding 17 and 19, and the caps C have been installed in the manner previously indicated. In addition, the curved shields 27 have been nailed in place as at 27*a* in the manner indicated in FIG. 9. The tees and hydraulic cylinders can then be removed.

Finally, after a proper layer of treated pesticide grease has been applied or painted on the confronting faces of the severed pole portions, the ladder sections LS can be removed from the channel members 13 and 15. They may be replaced if the reconstituted poles need to be climbed at some time in the future.

Figure 20:
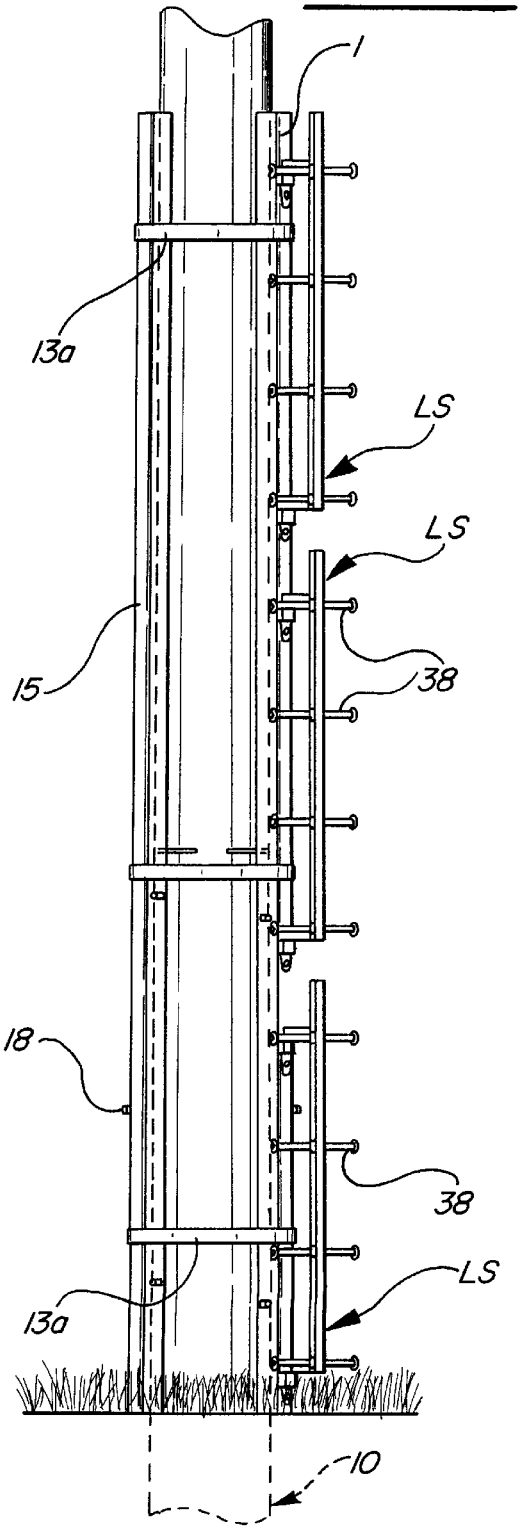

In practice, the ladder sections LS constitute working ladders which enable the erectors to climb to desired levels to install the bolts, bands, caps, and shields as well as the hydraulic cylinders. When the ladder sections LS are installed on the channel member 13, the workmen can climb to the required level to sequentially install each of the upper ladder sections LS on the member 13 and to remove the upper temporary bands 13*a* shown in FIG. 19. Once the channel 15 is placed adjacent the pole, replacement temporary bands 13*a*, which encircle both channels 13 and 15, are reinstalled as shown in FIG. 20, using the ladder as necessary. With the ladder sections LS for channel 15 installed and employed in the same manner, erectors can use them on both sides of the pole to most effectively accomplish the tasks which the method requires and then remove them or not. The ladder sections provide access in a variety of locations where the terrain does not permit other means of access to the poles.

The disclosed embodiment is representative of presently preferred forms of the invention, but is intended to be illustrative rather than definitive thereof. The inventive subject matter is defined in the claims.

The embodiment of the invention in which an exclusive property or privilege is claimed are defined as follows:

1. A method of raising the transmission hardware carried by a utility pole having a base end disposed in a ground foundation supporting the pole in upright position, comprising the following:

a. sequentially securing generally opposed, circumferentially spaced, elongate pole support members, with upper ends, to extend upwardly along the pole and dispose said upper ends at a first level a predetermined distance from the ground and severing the pole at a severing level below said first level to define a first pole supported by the pole foundation and a second pole supported by said first pole and circumferentially braced by said pole support members; said severing being sequentially effected with said pole being partially severed on one side and one of said support members then being positioned and secured alongside the pole on the said one side, said pole then being partially severed on the opposing side and the other support member then being positioned and secured alongside said pole on said opposing side, the remainder of said pole circumferentially between said pole support members then being severed to complete severing of said pole;

b. releasably attaching a vertically extending parallel ladder device with vertically spaced rungs to one of said pole support members after said one of said pole support members is secured;

c. raising said second pole a predetermined distance above said first pole to a level remaining below the upper ends of said pole support members; and d. climbing up said ladder device and fixing the lower end of said second pole within and to said upper ends of said pole support members at a spaced distance above said first pole in a cable raising position.

2. The method of claim 1 wherein said one of said pole support members is temporarily secured to said pole when said ladder device is attached and later is permanently secured to said other support member and pole.

3. A method of raising the transmission hardware carried by a utility pole having a base end disposed in a ground foundation supporting the pole in upright position, comprising the following:

a. partially severing the pole at a severing level at spaced circumferential severing locations and securing circumferentially spaced, elongate, rigid pole support members with upper ends, to extend upwardly along the pole directly radially adjacent said severing locations and dispose said upper ends at a first level a predetermined distance from the ground and completely severing the pole at said severing level to define a first pole supported by said pole foundation and a second pole supported by said first pole and carrying said hardware;

b. attaching vertically spaced steps to at least one of said pole support members;

c. without raising said first pole, raising said second pole a predetermined spaced distance above said first pole to a level remaining below said upper ends of said pole support members; and d. fixing the lower end of said second pole within and to said upper ends of said pole support members at a spaced distance above said first pole.

4. The method of claim 3 wherein said pole support members are fixed to said first pole below said severing level before said severing is complete.

5. The method of claim 3 comprising employing threaded fasteners connecting said spaced apart support members together at vertically spaced intervals vertically between said first pole and said raised second pole.

6. A method of raising the transmission cables carried by a utility pole having a base end enclosed by a ground foundation supporting the pole in upright position, without disturbing the pole foundation, comprising the following:

a. arranging a rigid elongate pole support member adapted to brace the pole to extend upwardly along the pole a predetermined distance from the ground and severing the pole at a severing level to define a first pole supported by the pole foundation and a second pole supported by the first pole and laterally braced by said pole support member;

b. gripping said second pole and elevating said second pole to a level remaining below the upper end of said pole support member; and c. fixing the lower end of said second pole to the upper end of said pole support member at a spaced distance above said first pole in a cable raising position.

7. The method of claim 6 comprising releasably attaching vertically spaced rungs to said pole support member and climbing said rungs to fix the lower end of said second pole to the upper end of said pole support member.

8. The method of claim 6 wherein a pair of circumferentially spaced rigid pole support members having upper ends are extended upwardly along the pole and said gripping and elevating is accomplished by releasably securing hydraulic cylinders on opposite sides of said pole between said first and second poles and activating said cylinders to extend their length.

9. The method of claim 8 comprising affixing laterally extending threaded members securing said pole support members together at vertically spaced intervals between said first pole and raised second pole.

10. The method of claim 6 wherein said pole support member is provided as a vertically elongate channel with a mount surface and curvilinear edges generally conforming to said poles, and said edges guide said second pole as it is raised upwardly and space said mount surface outwardly from said first and second poles; and releasably mounting vertically spaced steps on said mount surface of said pole support member.

11. The method of claim 6 wherein a pole reinforcer extends into the ground alongside said pole to stabilize the portion of the pole below ground and said pole support member is shaped to nest with said pole reinforcer and has terminal edges extending freely circumferentially beyond the edges of the pole reinforcer which secure directly to said first and second poles.

12. The method of claim 8 comprising ultimately permanently bolting said pole support members to said first and second poles and ultimately permanently metal-banding said pole support members to said first and second pole.

13. The method of claim 8 wherein said severing is sequentially effected with the pole being partially severed on one side and one of the support members then being driven alongside the pole on the said one side, the pole then being partially severed on the opposing side and the other support member then being driven alongside the pole on said opposing side, the remainder of the pole between said support members then being severed to complete severing of the pole.

14. The method of claim 7 wherein said rungs are provided as a series of vertically spaced sections which have multiple rungs secured to a vertically extending attachment strip and at least some of said strips are separately attached to said pole support members in upwardly attaching sequence and upon completion of said raising are detached in downwardly detaching sequence.

15. A reconstituted utility pole structure having a base end extending into and enclosed in the ground, connected by transmission cables to other such poles, and constructed in accordance with a method of raising said transmission cables, comprising the steps of; securing generally opposed, ground supported, circumferentially spaced, elongate pole support members to extend upwardly along the pole a predetermined distance from the ground and severing the pole at a severing location below the upper ends of said pole support members to define a fist base pole anchored in the ground and a second pole thereabove, and raising said second pole a spaced distance above said base pole to a level remaining below the upper ends of said pole support members; said pole structure including the following, in combination with said base pole:

a. said second pole having a lower end spaced above said base pole a climbable predetermined vertical distance;

b. said transmission cables being carried by said second pole;

c. said generally opposed, circumferentially spaced elongate pole support members having a configuration generally conforming to said base pole and said raised second pole and extending from the ground upwardly along said base pole and second pole a predetermined distance to a level above said lower end of said raised second pole;

d. ladder strips with vertically spaced rungs releasably attached to pole support members to provide access to said upper ends of said pole support members;

e. first fastener elements fixing said pole support members to said base pole; and f. second fastener elements fixing said lower end of said second pole within and to said upper ends of said pole support members at a spaced distance above said base pole in a cable raising position.

16. The pole structure of claim 15 wherein said pole support members have portions radially spaced from said poles and curvilinear edges conforming to said pole and engaging therewith; said ladder strips being attached to said portions spaced from said poles.

17. The pole structure of claim 15 wherein pole reinforcement members are driven into the ground adjacent the pole and secured to the pole to stabilize the lower end of said pole, and said pole support members nest with and secure said pole reinforcement members.

18. The pole structure of claim 15 wherein curvilinear plates secured to said pole lap the edges of said pole support members circumferentially between said vertically spaced base pole and second pole.

19. The pole structure of claim 15 wherein laterally extending threaded fastener members secure said pole members together vertically between said first and second poles.

20. The pole structure of claim 15 wherein said ladder strips are vertically spaced from one another at a distance to provide ready climbing up the rungs of the strips.

* * * * *